US005901964A

United States Patent [19]

Williams et al.

[11] Patent Number: 5,901,964

[45] Date of Patent: May 11, 1999

[54] SEAL FOR A LONGITUDINALLY MOVABLE DRILLSTRING COMPONENT

[75] Inventors: John R. Williams, 3816 Spring Mountain Rd., Fort Smith, Ark. 72901; Don M. Hannegan, Fort Smith, Ark.

[73] Assignee: John R. Williams, Fort Smith, Ark.

[21] Appl. No.: 08/796,380

[22] Filed: Feb. 6, 1997

[51] Int. Cl.[6] ..... E21B 33/06

[52] U.S. Cl. ..... 277/326; 277/343; 264/108; 264/326; 264/349

[58] Field of Search ..... 277/326, 343, 277/560, 936, 322, 324, 325; 166/84.1, 84.3; 264/108, 325, 326, 349

[56] References Cited

U.S. PATENT DOCUMENTS

| | | | |
|---|---|---|---|
| 2,170,915 | 8/1939 | Schweitzer | 277/332 |
| 2,170,916 | 8/1939 | Schweitzer | 277/326 |
| 2,175,648 | 10/1939 | Roach | 285/110 |
| 2,243,439 | 5/1941 | Pranger et al. | 277/329 |
| 2,287,205 | 6/1942 | Stone | 277/327 |
| 2,731,281 | 1/1956 | Knox | 277/326 |
| 2,746,781 | 5/1956 | Jones | 277/566 |
| 2,808,229 | 10/1957 | Bauer et al. | 175/7 |
| 2,862,735 | 12/1958 | Knox | 277/326 |
| 3,029,083 | 4/1962 | Wilde | 277/343 |
| 3,387,851 | 6/1968 | Cugini | 277/318 |
| 3,619,430 | 11/1971 | Hiratsuka et al. | 277/936 X |
| 4,363,357 | 12/1982 | Hunter | 166/84.3 |
| 4,367,795 | 1/1983 | Biffle | 166/84.3 |
| 4,371,177 | 2/1983 | Bahr et al. | 277/560 |
| 4,383,577 | 5/1983 | Pruitt | 166/95.1 |
| 4,441,551 | 4/1984 | Biffle | 277/326 X |
| 4,486,025 | 12/1984 | Johnston | 277/343 |
| 4,500,094 | 2/1985 | Biffle | 277/326 |
| 4,949,796 | 8/1990 | Williams | 175/209 |
| 5,028,056 | 7/1991 | Bemis et al. | 277/936 X |
| 5,376,726 | 12/1994 | Noyama et al. | 525/193 |
| 5,489,631 | 2/1996 | Dubois | 264/108 X |
| 5,498,212 | 3/1996 | Kumazaki | 474/263 |
| 5,526,859 | 6/1996 | Saito et al. | 152/209 R |
| 5,647,444 | 7/1997 | Williams | 175/209 |
| 5,662,181 | 9/1997 | Williams et al. | 175/195 |
| 5,702,564 | 12/1997 | Itoh et al. | 264/108 X |

OTHER PUBLICATIONS

Williams Tool Co., Inc., "Rotating Control Heads and Strippers for Air, Gas, Mud, and Geothermal Drilling," pp. 1–16, Fort Smith, Arkansas 1988.

Williams Tool Co., Inc., "Rotating Control Heads and Strippers for Air, Gas, Mud, and Geothermal and Horizontal Drilling," pp. 1–16, Fort Smith, Arkansas 1991.

Akzo Nobel Fibers, Inc., ":Trelleborg—Use of Trell–MB in Rubber," pp. 1–2, Conyers, Georgia 1991.

Akzo Nobel Fibers, Inc., ":Trelleborg—Trell–MB Masterbatch," p. 1, Conyers, Georgia 1991.

Hannegan, "Applications Widening for Rotating Control Heads," Drilling Contractor, pp. 17–19, Drilling Contractor Publications Inc., Houston, Texas Jul., 1996.

Article "Short para aramid fiber reinforcement" by J.F. van der Pol & L.J. de Vos. Akzo Nobel Fibers (6 pages), *Rubber World*, Jun., 1994.

*Primary Examiner*—Eric K. Nicholson
*Assistant Examiner*—Greg Binda
*Attorney, Agent, or Firm*—Akin, Gump, Strauss, Hauer, & Feld, L.L.P.

[57] ABSTRACT

A stripper rubber for oil and gas wells, water and geothermal wells, having an interior surface design which includes a circular, convex knee portion in the throat area of the stripper rubber to provide additional support to the stripper rubber during insertion of a tubular member through the stripper rubber. The composition for the stripper rubber includes, in one embodiment, enhanced wear characteristics by the addition of milled fibers of Twaron® mixed homogeneously throughout the stripper rubber.

26 Claims, 4 Drawing Sheets

SEAL FOR A LONGITUDINALLY MOVABLE DRILLSTRING COMPONENT

CROSS-REFERENCE TO RELATED APPLICATIONS

Not applicable.

BACKGROUND OF THE INVENTION

1. Field of the Invention

This invention relates to a long-lasting, generally tubular, rubber or elastomer-based seal having a configuration for sealing against tubular members or drillstring components movable longitudinally through the seal, such as stripper rubber seals for rotating control heads, rotating blowout preventers, diverter/preventers and the like, used in oil, gas, coal-bed methane, water or geothermal wells.

2. Description of the Related Art

In the drilling industry, seals are used in various applications including rotating blowout preventers, swab cups, pipe and Kelly wipers, sucker rod guides, tubing protectors, stuffing box rubbers, stripper rubbers for coiled tubing applications, snubbing stripper rubbers, and stripper rubbers for rotating control heads or diverter/preventers. Stripper rubbers, for example, are utilized in rotating control heads to seal around the rough and irregular outside diameter of a drillstring of a drilling rig. Stripper rubbers are currently made so that the inside diameter of the stripper rubber is considerably smaller (usually about one inch) than the smallest outside diameter of any component of a drillstring. As the components move longitudinally through the interior of the stripper rubber, a seal is continuously effected. Stripper rubbers are self-actuating in that as pressure builds in the annulus of a well, and in the bowl of the rotating control head, the vector forces of that pressure bear against the outside surface or profile of the stripper rubbers and compress the stripper rubber against the outside surface of the drillstring, thus complementing resilient stretch fit forces already present in the stripper rubber. The result is an active mechanical seal which increases sealability as well bore pressure increases.

Stripper rubbers seal around rough and irregular surfaces such as those found a drill pipe, tool joints, and a Kelly, and are operated under well drilling conditions where strength and resistance to wear are very important attributes. In utilizing stripper rubbers in rotating control heads, the longitudinal location of the rotating control head is fixed due to the mounting of stripper rubbers onto bearing assemblies which allow the stripper rubbers to rotate with the Kelly or drillstring but restrain the stripper rubbers from longitudinal movement. Thus, relative longitudinal movement of the drillstring including the end to end coupling areas of larger diameter joints and the larger diameter of tools that bear against a stripper rubber thereby causing wear of the interior surface of the stripper rubbers.

The wear upon stripper rubbers will, over a period of time, cause a thinning of the stripper rubber to the point that the stripper rubber will fail. Such wear is enhanced or increased when multiple lengths of a drillstring are moved through the stripper rubbers, such as when a drillstring is "tripped" into or out of the well. Longer wear of stripper rubbers has been a long felt need in the industry. The advantage of a longer lasting stripper rubber is not only one of safety, but also one of expense since a longer lasting stripper rubber will reduce the number of occasions when the stripper rubbers must be replaced, an expensive and time consuming undertaking.

It is generally known that the mechanical properties of rubber-based products may be enhanced through the addition of para aramid fibrillated short fibers (pulp) and para aramid dipped chopped fibers (DCF) in applications such as hoses, V-belts and tires. Akzo Noble Fibers, Inc. of Conyers, Ga. through its European operation is one manufacturer of such reinforcing products, selling a product under the trademark Twaron®. A similar product is available from another manufacturer under the trademark Kevlar®. Twaron® is Akzo's organic manmade high performance para aramid fiber. Its chemical designation is poly (para-phenylen terephthalamid).

Twaron® fibers have been used in transmission belts where short fiber reinforced rubber is located under the cord layer, the short fibers being oriented perpendicular to the surface that transfers power. The increased hardness of the rubber in the fiber direction gives the transmission belt a lower friction coefficient, a reduced noise level when in service, a lower heat build up during cyclic compression and an increase in transmission capability. Twaron® fibers have also been used in the manufacture of hoses such as an automotive heater hose which is reinforced with a knitted (para aramid) continuous filament yarn construction. Para aramid pulp has also been used in the inner liner of grated high pressure hoses to provide an increased green strength of the liner and an improved production stability, coupling retention and better fatigue resistance.

Twaron® fibers are also utilized in tires. In the bead area, aramid short fibers give fewer mixing problems than high levels of high surface area carbon blacks. Advantages are offered by the high anisotropy and the increased dynamic modulus leading to a lower heat build-up which extends the life of the bead compound and preserves the adhesion between bead wire and bead compound. When short fibers are used in a tire tread compound, advantages include a lower rolling resistance of the tire, better water drainage, more uniform wear and possibly less noise.

In an article entitled *Short Para Aramid Fiber Reinforcement* published in *Rubber World* in June, 1994, van der Pol and de Vos of Akzo Nobel Fibers disclosed that para aramid pulp or DCF may provide certain advantages for rubber seals and oilwell packings including better mechanical properties at elevated temperatures, less creep, higher abrasion resistance and less swelling by solvents. Van der Pol and de Vos taught that short fibers provide abrasion resistance to rubber and suggested using Akzo's Twaron® fibers in applications such as V-belts, footwear, seals, rolls, tank-pads, gaskets, automotive hoses, conveyor belts, pneumatic tires, protection of mines and dams and roofing. This article is incorporated by reference.

In spite of the general knowledge pertaining to enhancing properties of rubber, there remains a long-standing problem of wear in seals and wipers used for drilling components. Wear is caused by relative movement of a drillstring or production well component against the rubber seal or wiper. Wear is present in all drilling and production applications where a rubber seal or wiper is subjected to the relative movement of a component such as drillstring tools, Kelly, pipe, or rod for the purpose of sealing, wiping, stripping, snubbing and/or packing off well fluids when drilling or producing oil or gas from a well. There remains a long-felt need for a rubber seal or wiper that is resistant to wear and capable of a longer service life than has been heretofore possible.

SUMMARY OF THE INVENTION

This invention provides a seal or wiper having enhanced properties for resistance to wear and/or a shape for providing a longer life for the seal or wiper. Short fibers are mixed into a rubber or elastomer material to improve properties including resistance to abrasion, tensile strength and coefficient of friction.

In one aspect, this invention provides a stripper rubber having a new and improved combination of various types of rubber and wear reducing fibers located in nose and throat sections of the stripper rubber. In one aspect of the invention, short fibers are mixed with the rubber or elastomer prior to vulcanization in order to reduce wear and enhance stripper rubber life. Preferably, short fibers are oriented radially in the nose section so that ends of the fibers are exposed to a wear surface, thus resisting wear. In another embodiment of the invention, longer fibers are preferably used in the throat section of the stripper rubber to increase tensile strength so that the stripper rubber can withstand higher pressure in the annulus of a well bore. This reduces a tendency for a stripper rubber to blow out and thus increases the life of the stripper rubber.

In another aspect the invention provides a stripper rubber having an interior shape that includes a convex knee component for a transition between a circular section and an inwardly tapered section. The convex knee component helps to prevent blowouts under extreme pressure conditions by serving as a strengthening spacer between the pressure condition and a drilling or production component sealed within the stripper rubber. As pressure builds in the annulus, the convex knee component presses into engagement against the drillstring or production component. The convex knee component also provides a thick wear area for receiving and centering components before stretch engagement with a nose section.

DESCRIPTION OF THE PREFERRED EMBODIMENTS

The present invention provides a rubber or elastomer composition including fibers for seals, wipers and the like, which are hereinafter referred to generally as seals or stripper rubbers. The present invention further provides a life-extending configuration for stripper rubbers. The term "rubber" or "rubbers" includes members made of natural or synthetic rubbers or elastomers, and such terms shall have this meaning throughout this patent.

Figure 1:
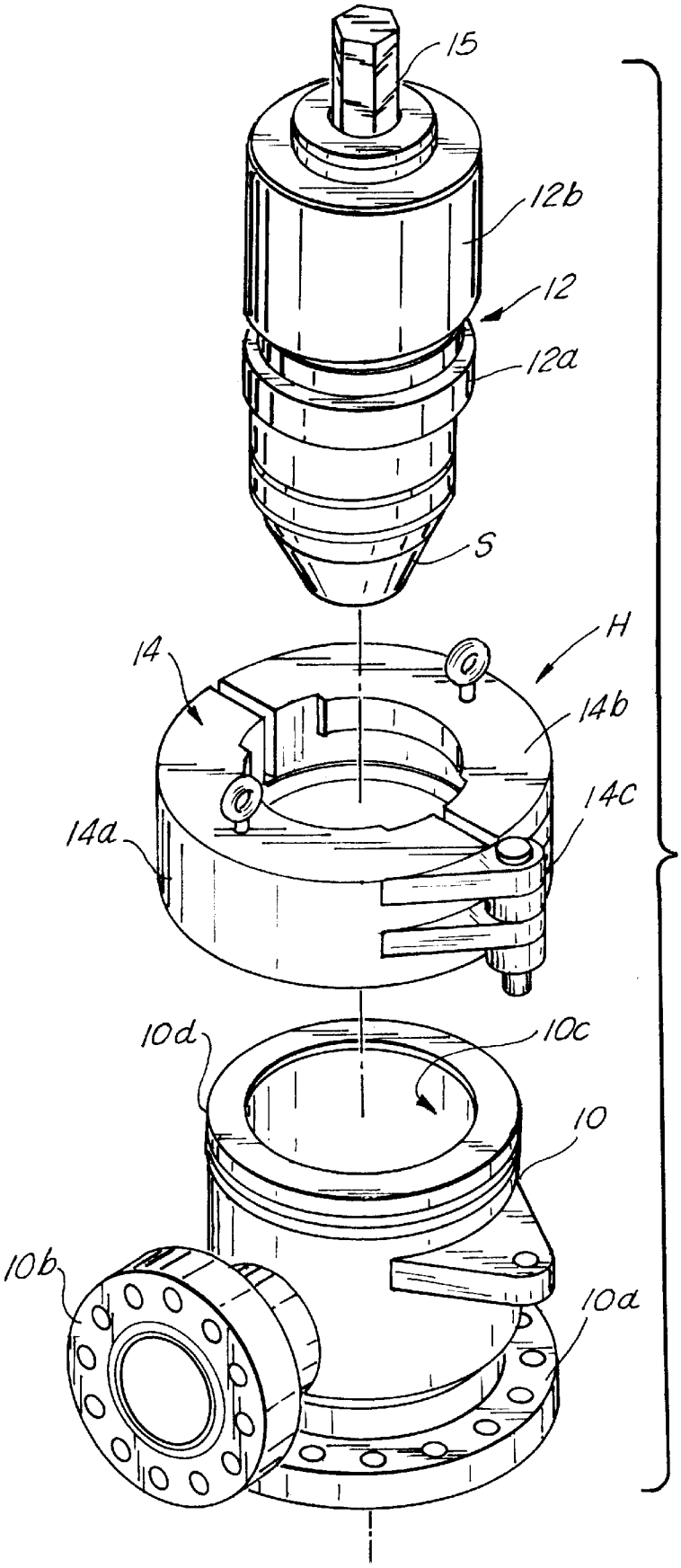
FIG. 1 is a generally perspective but schematic view of a rotating blow-out preventer utilizing the stripper rubbers of this invention.

Referring to the drawings and in particular FIG. 1, a rotating control head H is illustrated generally. Such a rotating control head includes a bowl housing 10 which includes a bottom mounting flange 10*a* and a flow diversion outlet 10*b*. The bowl housing 10 has a bore generally designated as 10*c* which is adapted to receive a bearing assembly and two stripper rubbers, this combination being generally designated as a bearing and stripper rubber assembly 12. The bearing and stripper rubber assembly 12 is mounted within bore 10*c* by a suitable clamp mechanism 14. Typically, clamp mechanism 14 includes opposing semicircular clamp arms 14*a* and 14*b* which are hinged together by a hinge 14*c*. Clamp arms 14*a* and 14*b* envelope and engage an upper rim 10*d* of the bowl housing 10 and an exterior bearing housing 12*a* of the bearing and stripper rubber assembly 12.

A drillstring component, such as a Kelly 15, is shown extending through the bearing and stripper rubber assembly 12. It should be understood that the stripper rubber of this invention may be used in drilling and production operations relating to oil, gas, including methane, water and geothermal resources. Examples include drillstring components, such as lengths of drillstring, coiled tubing, tools and other tubular elements that may extend through the bearing and stripper rubber assembly 12 for extension downhole in a well. The bearing and stripper rubber assembly 12 mounts for rotatable movement a lower stripper rubber 16*a* and an upper stripper rubber, which is not shown but is contained within a rotatable pot 12*b*. Rotatable pot 12*b* is attached to an interior bearing housing (not shown), which is known in the art of dual stripper rubber rotating control heads. Rotating control heads are available from Williams Tool Company of Fort Smith, Ark., and Models 7000 and 7100 are typical for this application. An upper (not shown) stripper rubber and lower stripper rubber 16*a* are mounted for rotatable movement, receiving Kelly 15 or other well bore component which extends through the stripper rubbers such as 16*a*. While this description is directed to a particular composition and structure for the stripper rubber 16 as illustrated in FIGS. 1–4, it should be understood that the principles of this invention apply to other types of rotatable and non-rotatable seal elements for well bore components, applications including swab cups, sucker rod guides, tubing protectors, stuffing box rubbers, stripper rubbers for coiled tubing applications, snubbing stripper rubbers, and pipe and Kelly wipers.

Generally, stripper rubbers of many configurations are known in the art. Stripper rubber 16 is an improved version of a stretch-fit/self-actuating stripper rubber, wherein the inside diameter which seals around the well bore component 15 is smaller than the outside diameter of the well bore component 15 so that the bottom portion or nose of the stripper rubber 16 stretches to fit tightly around and against the component 15. Well bore pressure in the annulus applies force against the stripper rubber 16, thus self-actuating a mechanical seal between the interior surface of the stripper rubber 16 and the exterior surface of the component 15.

Stripper rubber failure is a serious problem since it can create an unsafe condition, particularly if an unexpected pressure surge or "kick" or sour gas is present in the well bore while drilling. The continuous removal and reassertion of well bore components 15 into and out of the well exposes the stripper rubber 16 to great wear. Because wear is a problem of great concern, it is generally recommended that well operators visually inspect the condition of the stripper rubber 16 at least once every 24 hours. The stripper rubber 16 of this invention is designed to provide superior wear while maintaining excellent sealing characteristics over a broader range of well pressures as compared to currently known stripper rubbers.

Figure 3:
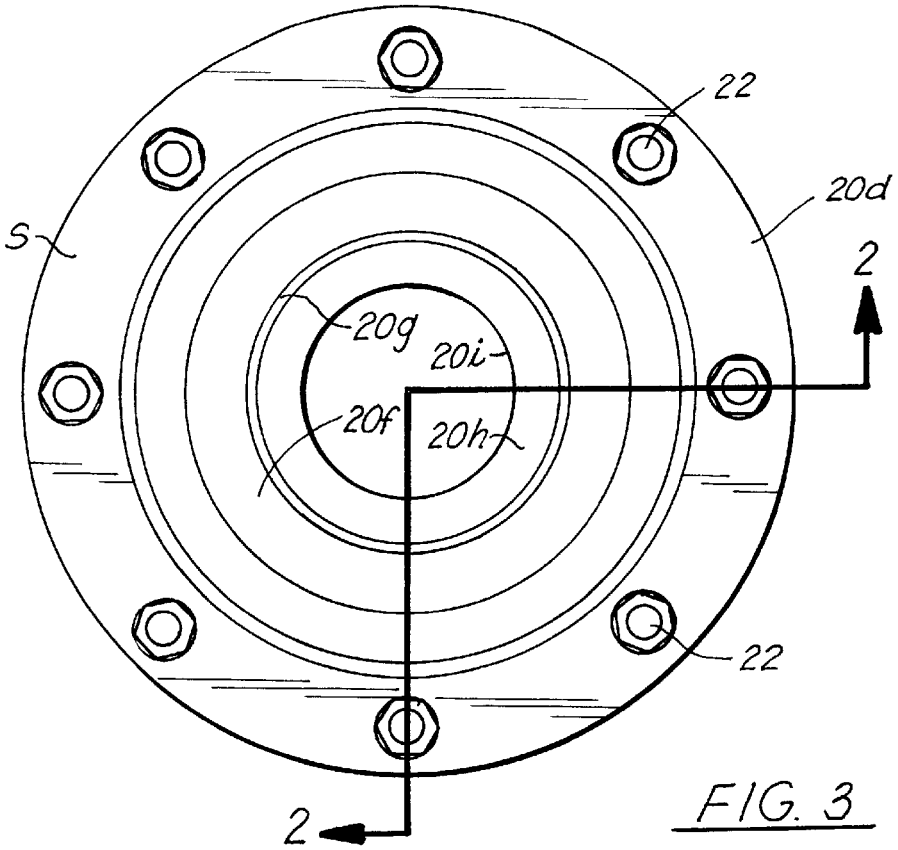
FIG. 3 is a top view of the stripper rubber of this invention.
Figure 2:
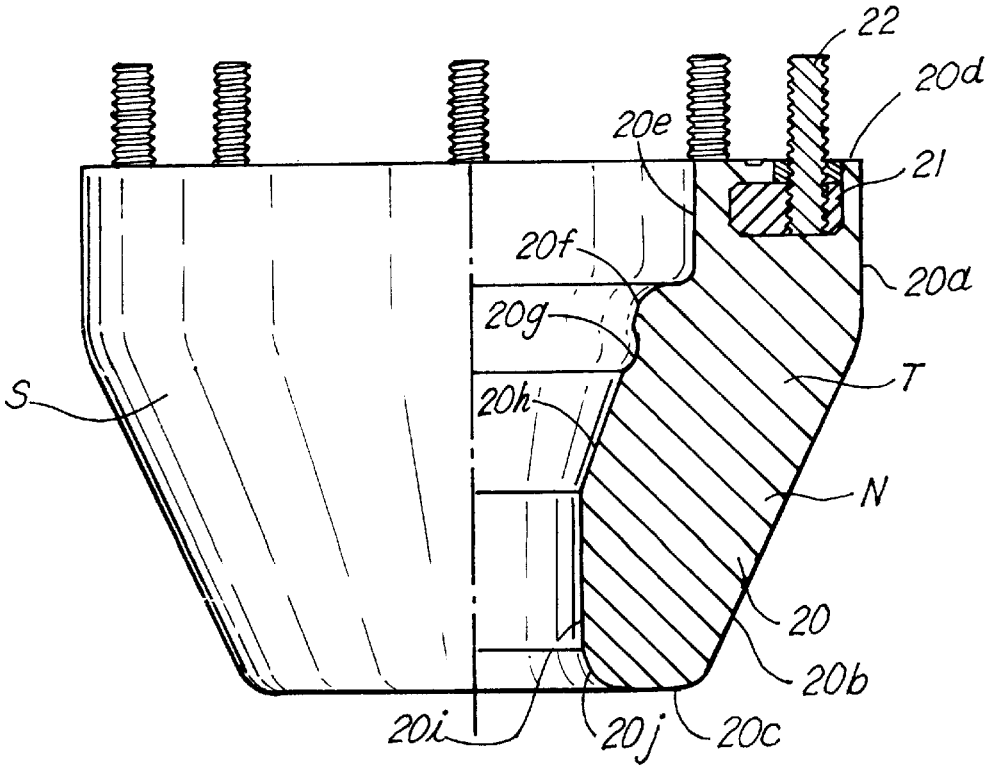
FIG. 2 is a side view, partly in section of the stripper rubber of this invention.

Referring to FIGS. 2 and 3, the stripper rubber 16 of this invention is illustrated. The stripper rubber 16 includes a generally frusto-conical rubber component 20, the composition of which is described in more detail below. Rubber component 20 has a generally frusto-conical exterior configuration and thus includes a generally cylindrical exterior portion 20*a* and a generally conically tapered exterior portion 20*b*. Rubber component 20 terminates in a bottom annular rim 20*c* and a top annular rim 20*d*. During manufacture, a metal ring 21 is inserted near the top annular rim 20*d* to receive a series of bolts 22 circumferentially spaced about the circumference of the stripper rubber 16 for mounting of the stripper rubber 16 within the bearing and stripper rubber assembly 12. The stripper rubber 16 may generally be defined as having an upper section herein generally designated by the letter T as a throat and a lower section generally designated by the letter N as a nose.

The interior of the stripper rubber 16 includes a series of surface areas for accommodating well bore components 15. A cylindrical surface 20*e* joins a convex knee component 20*f* which in turn joins a concave interior surface portion 20*g*. The concave interior surface portion 20*g* joins an inwardly tapered interior surface portion 20*h*, which joins a cylindrical interior portion 20*i*, which finally terminates in a radius interior corner portion 20*j*. The radius of curvature of the convex knee portion 20*f* is substantially larger than the concave knee portion 20*g*. The internal diameter of the cylindrical interior portion 20*i* is smaller than the smallest diameter of the various well bore components 15.

Thus, the cylindrical interior portion 20*i* must stretch to accommodate the well bore component 15 which is stabbed through the bore of the stripper rubber 16. This stretch fit provides a tight mechanical seal around the well bore component 16 against leakage between the exterior surface of the well bore component 15 and the cylindrical interior portion 20*i*. If the well bore component 15 rotates, then the stripper rubber 16 rotates with it. If pressure builds in the annulus of the well bore, flow is directed out the flow diversion outlet 10*b* to control the pressure. Pressure in the well annulus applies force to exterior of portions 20*a* and 20*b*, which presses the cylindrical interior portion 20*i* even more tightly against the well bore component 15.

The convex knee component 20*f* provides additional strength to the stripper rubber 16 under high pressure conditions, reducing the likelihood of failure of the stripper rubber 16 due to a blow out, which can rip and tear the rubber and thus cause failure of the seal. The interior portion 20*i* located in the nose N of the stripper rubber provides a seal against the well bore component or Kelly 15, but surfaces 20*e*, 20*f*, 20*g* and 20*h* do not provide a seal.

In the embodiment illustrated, the overall diameter of the outside portion 20*a* of the stripper rubber 16 is 15 inches and the inner diameter of the cylindrical interior portion 20*i* is 4.125 inches. The overall height, that is, the distance from the top annular rim 20*d* to the bottom annular rim 20*c* is about 10–14 inches. For a stripper rubber of this size, and similar sizes, the convex knee component 20*f* has a 0.75-inch radius.

When the well bore component 15 is inserted into the stripper rubber 16, the convex component knee 20*f* serves as a bumper for centering the component 15. When larger components 15 are being pushed through the stripper rubber 16, the convex knee component 20*f* initiates the additional stretching process required to accommodate these larger diameter areas of the components 15.

When drilling, with high pressure in the bowl housing 10 of the rotating control head, the convex knee component 20*f* provides additional rubber strength and mass (as represented in cross-sectioned area) in the throat area T of the stripper rubber, and under high-pressure drilling or "kick" pressure surges, the presence of the knee component 20*f* serves to limit the travel of the throat section T before it comes to bear against the drill pipe or other component. This reduces the tendency of the stripper rubber 16 to blow out under extremely high pressure conditions.

High pressure in the annulus provides a force that tends to shear the throat section T. This force presses the convex knee component 20*f* against the exterior surface of the well bore component or Kelly 15, which counters the pressure force. With the convex knee component 20*f* pressed against the component 15 the throat section T is under primarily compression rather than tension. Rubber can much more readily withstand a compressive force than a tensile force. Theoretically, the shape of the convex knee component 20*f* may also alter the distribution of tensile forces, but in any case, convex knee component 20*f* helps stripper rubber 16 to withstand high pressure forces.

Stripper rubbers 16 fail for two basic reasons: Stripper rubbers wear out from abrasion in the mechanical sealing area 20*i* in the nose N, or they blow out in the throat area T. The convex knee component 20*f* enhances the pressure resistance of the stripper rubber 16 against blowout in the throat area T.

Another aspect of this invention deals with adding fibers to the rubber compositions in order to enhance the wear characteristics and pressure resistance of the nose area N and throat area T, respectively, of the stripper rubber 16.

The various types of rubber which are used to manufacture stripper rubbers 16 include natural rubbers, nitrile rubbers, butyl rubbers, and ethylene propylene diamine rubbers. In addition, the "stripper rubber" includes polyurethane as another material. Typically, natural rubbers are used in water-based drilling muds. A typical natural rubber composition is provided in Table 1, where the additives are provided in parts per hundred parts of rubber (PHR).

When the exposure of the rotating control head will be to an oil-based drilling mud, it is known to use a nitrile type of rubber composition. A typical nitrile-based rubber has 40% ACN and additives as described in Table 1, but it should be understood that these compositions can be varied.

TABLE 1

Typical Rubber Compositions

| Additives (PHR) | Natural | Nitrile | Butyl | EPDM |
|---|---|---|---|---|
| Carbon Black | 80 | 58 | 70 | 85 |
| Stearic Acid | 1.0 | 1.0 | 1.0 | 1.0 |
| Zinc Oxide | 5.0 | 5.0 | 5 | 5 |
| Wax | — | — | 3.0 | 3.0 |
| Sulfur | 2.0 | 2.4 | 0.25 | 0.25 |
| Polyethylene | — | — | 5.0 | 10 |
| Paraffinic Oil | — | — | 5 | 5 |
| Synthetic Plasticizer | — | 4.75 | — | — |
| Accelerator | 0.75 | 0.6 | — | — |
| Antioxidant | 1.0 | 1.0 | — | — |
| Retarder | — | 0.3 | — | — |
| Process Aids | 5.7 | 1.0 | — | — |
| Hydrocarbon Resin | 5.0 | — | — | — |
| Napthenic Process Oil | 5 | — | — | — |
| Peptizer | 0.7 | — | — | — |

And, when the environment is geothermal, it is known to use butyl rubber compositions. A typical composition has 90% butyl and 10% ethylene propylene diamine (EPDM) rubber and additives as described in Table 1.

Where the stripper rubbers will be exposed to potential chemical corrosion, a higher concentration of EPDM rubber can be used. A typical composition has about 80% butyl and 20% EPDM rubber and additives as described in Table 1.

The aspect of this invention pertaining to the mixing of certain fibers into a rubber is applicable for any rubber composition, the compositions in Table 1 being illustrative. Property enhancement through the addition of fibers is applicable to various types of rotatable or non-rotatable seals, wipers and sealing elements utilized in well drilling and production applications. However, the preferred embodiment of this invention is directed to the particular application disclosed, that is, for a high wear, high performance stripper rubber 16 for use in a rotating control head or similar equipment as previously described.

This invention is directed to a range of para or meta aramid fibers suitable for enhancing the abrasion resistance, tensile strength and other properties of various rubber compositions used as seals and wipers for well components. Para aramid fibers are identified as poly (para-phenylen terephthalamid). Para aramid fibrillated short fibers (pulp), para aramid dipped chopped fibers (DCF), and para aramid fiber dust can be mixed into rubber to enhance certain properties including resistance to abrasion and tensile strength. When para aramid fiber dust is used, it is preferably added to provide less than 10% by weight, preferably 3–4% by weight.

In adding such fibers to rubber care must be taken to ensure adhesion of the fiber to the rubber or elastomer and to ensure optimal dispersion of the fibers in the rubber. Physicochemical adhesion between fibers and rubber can be achieved by applying an adhesive layer to the fibers before mixing into the rubber. Formulations containing resorcinol-formaldehyde-latex (RFL) can be used with para aramid fibers to improve adhesion between the fibers and the rubber. Proper dispersion is achieved by adequate mixing, applying sufficient shear forces to the mixture of fibers and rubber. Inadequate dispersion of fibers results in clumps of fiber in the rubber product, providing potential failure sites.

In one embodiment of this invention, the entire rubber composition of the stripper rubber 16 is mixed with short length, high wear enhancing fibers having a length of typically less than 10 millimeters (mm) and preferably about 1–3 mm. One source of such high wear fibers is Akzo Nobel Fibers, Inc. of Conyers, Ga., manufacturing through its foreign operations and selling suitable fibers under the trademark Twaron®, as described in the Background of the Invention. These fibers sold under the Twaron® mark have fiber designations in the range of "5000–5011" and are defined as milled fibers and are already known to generally increase wear in rubber products. Para aramid fibers are also available from Akzo Nobel Fibers, Inc. in a master batch under the trademark TRELL-MB® which consists of 40% aramid pulp (Twaron®), 40% carbon black (semi-reinforcing) and 20% polymeric rubber compatilizer. Because the short-fiber-rubber composite is much stiffer than rubber, it can be used to reinforce and create a dimensionally stable rubber. Para aramid can be used as a continuous filament yarn, short fiber or pulp fiber. Para aramids have a strongly crystalline structure, a high strength, a high decomposition temperature and a high resistance to elevated temperatures and most organic solvents.

Short length para aramid fibers of 1–3 millimeters are mixed into the rubber composition during manufacture in such a manner as to provide a random orientation of fibers. The fibers are typically incorporated in an amount less than 10% by weight and preferably about 2% by weight. A reasonable portion of the short fibers will be generally radially oriented in the nose area N of the stripper rubber 16. In addition, it has been observed that the nose portion N has higher lubricity to well bore components, which is most likely due to the portion of the fibers in the nose N which are oriented generally longitudinally. The purpose of the radial orientation is to provide or expose end portions of the short fibers to the wear action of well bore component 15 moving through the stripper rubber nose portion N, and in particular in the area of the interior cylindrical wear portion 20*i*. The addition of the short fibers in the nose area N allows the stripper rubber 16 to maintain its stretchability or elongation so as to receive tubular members moving through the interior of the stripper rubber but at the same time provide additional wear enhancing capability so that the life of the stripper rubbers 16 is increased.

In another embodiment para aramide pulp or DCF is oriented in the machine direction by calendering the green rubber. This green rubber is then placed in a mold for making the stripper rubber 16. The green rubber is placed in the mold so that orientation is generally maintained and generally directed in a radial direction in the nose section N. In this manner a high proportion of the fibers are oriented so that ends of the fibers contact the well bore component 15, providing surface area that resists abrasion. The stripper rubber 16 is completed by vulcanizing the rubber, subjecting the rubber to heat and pressure for a certain time as is known to those skilled in the art. For all purposes, U.S. Pat. Nos. 5,526,859, issued to Saito et al., and 5,498,212, issued to Kumazaki, are incorporated by reference.

Figure 4:
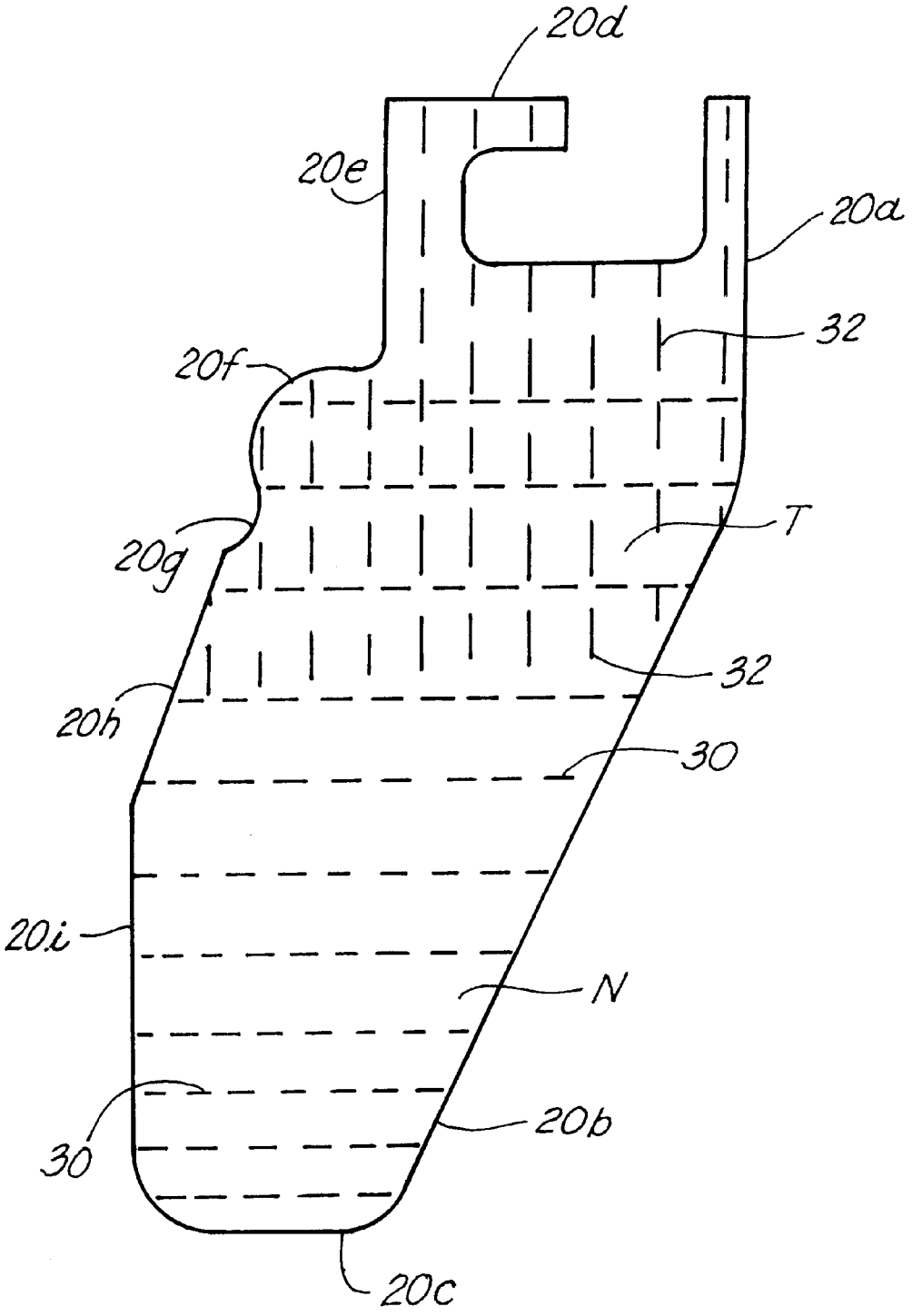
FIG. 4 is a cross section of a stripper rubber having fibers according to a second embodiment of the present invention.

In another embodiment as shown in FIG. 4, the nose portion N of the stripper rubber is manufactured with the same chopped fibers of Twaron® of about 1–3 millimeters in length and in sufficient amounts, such as 2% by weight, to provide sufficient fibers of generally radial orientation to provide wear enhancement in the nose area N, which is due to the wear resistance of the end portions of the radially directed fibers. In this embodiment, the upper throat portion T contains longer fibers of Twaron® oriented longitudinally within the throat area T to provide additional tensile strength. The fibers comprise less than 10% by weight, preferably about 2%, and range in size from about 3 mm to continuous. Due to the addition of 2% Twaron® by weight, a like amount of carbon black by weight can be removed. Preferably the fibers in the throat area T having interior surfaces 20*f*, 20*g* and 20*h* have a length ranging between about 3 and 10 mm.

These longer fibers provide additional tensile strength for resisting the tendency of stripper rubber 16 to blow out when high pressure builds on the exterior surface of stripper rubber 16. Longer fibers reduce stretchability, but stretchability is not an essential feature of the throat area T, where resistance to pressure is the critical characteristic needed. In the throat area T, which may be generally defined to be the top one third to one half of the stripper rubber 16, the utilization of longer fibers of Twaron® in combination with use of the shorter fibers in the nose area N, enhances wear resistance but still allows stretchability or elongation, producing a stripper rubber 16 which has a higher resistance to external pressure but also longer wear in the area of engagement of well bore components 15.

General Method of Manufacture

The method of manufacture of the stripper rubbers 16 of this invention utilizes generally known techniques for manufacture of compression molded stripper rubbers. Generally, sheets of rubber, natural rubber, butyl rubber or other rubber, are provided in 4 foot by 4 foot sections of approximately ½ inch thickness. These sheets are cut into approximately 6 inch strips and are calendered or spread out in known calendering equipment. As the sheets are spread out, the resultant calendered pieces are wadded back up and run through the calender process again and again, such that the rubber is generally kneaded in a known manner. During this process, the desired fibers are added in an amount of approximately 2% by weight. Short fibers for the nose section N are oriented radially in sufficient quantity to enhance wear of interior surface 20*i* in the finished product as described below.

After approximately 25 or 30 pounds have been moved through the calendering process and the fibers have been added and mixed therein, the calendered material is then cut into strips and wrapped into a turban or doughnut shape and is then inserted into a typical compression mold, which in this case has the configuration for the stripper rubber 16. Hydraulic pressure is then applied in conjunction with electrically otherwise heated platens to press and vulcanize the kneaded material into stripper rubber 16. Aside from the composition and the particular structure as described for the stripper rubber of this invention, the remainder of the process for actual manufacture and vulcanization of the stripper rubber product is well known in the art.

Fiber should be added so as to take maximum advantage of its properties, and thus the fiber should be oriented in a proper direction for the end application. For example, the convex knee component 20*f* is subject to wear as well bore components 15 bump into and slide along it. Fibers are preferably oriented so that ends are exposed at the interior surface of convex knee component 20*f* and at the interior surface of cylindrical interior portion 20*i*. Fibers can be oriented in the green rubber during the mixing process by using conventional elastomeric compounding techniques such as extruding, milling or calendering previously referred to. These compounding techniques orient the fiber in the machine direction. This orientation can be maintained and applied in the stripper rubber 16.

Calendered sheets of rubber have the fibers generally oriented longitudinally, that is, in the machine direction. By cutting strips in a cross machine direction and placing these strips in a mold for the nose section N, the fibers can be generally oriented radially in the nose section N so that ends of the fibers 30 are exposed at internal surfaces. This is illustrated schematically in FIG. 4, where fibers 30 have ends exposed at the interior surface of cylindrical interior portion 20*i*, providing a surface that is resistant to wear. For the throat section T, strips can be cut in the machine direction of a rubber having longer fibers 32 and placed upright in the mold so that the longer fibers 32 are generally oriented longitudinally in the stripper rubber 16 or generally parallel to the surfaces of the exterior portions 20*a* and 20*b*. These fibers in the throat section T greatly increase the tensile strength of the rubber compound allowing the stripper rubber 16 to withstand great forces applied by high pressures on the surfaces of the exterior portions 20*a* and 20*b*.

Testing of a Homogeneous Stripper Rubber

Referring to the first embodiment of the stripper rubber of this invention wherein the entire stripper rubber composition received 2% by weight of the 1–3 mm Twaron® milled fibers for enhancement of wear, the Petroleum Engineering and Technology Transfer Laboratory of Louisiana State University tested such a stripper rubber in a Williams Tool Company Model 7100 rotating control head. The Model 7100 was developed to extend and/or balance horizontal drilling operations to greater depths and higher formation core pressures. The Model 7100 is shell tested to 10,000 psi and is designed for a working pressure of 5,000 psi when the pipe is static and a working pressure of 2,500 psi for drilling or stripping operations. Due to these high pressure operations, the stripper rubber of this invention was developed. It is known that the most severe conditions for a rotating control head are experienced when a tool joint passes through the nose or sealing area N of a stripper rubber under high pressure, especially when the tool joint or other tubular member is being removed from the well.

In this test, a 340,000 lb hydraulic workover unit was used to reciprocate a a 5-inch drill-pipe having a 6.625-inch tool joint through a rotating control head under various wellhead pressures. The tool joint used has an 18 degree taper on both the box and pin end and had no hard-banding or identification ring grooves. The test was performed at the Hydraulic Well Control, Inc. facility in Houma, La.

Figure 5:
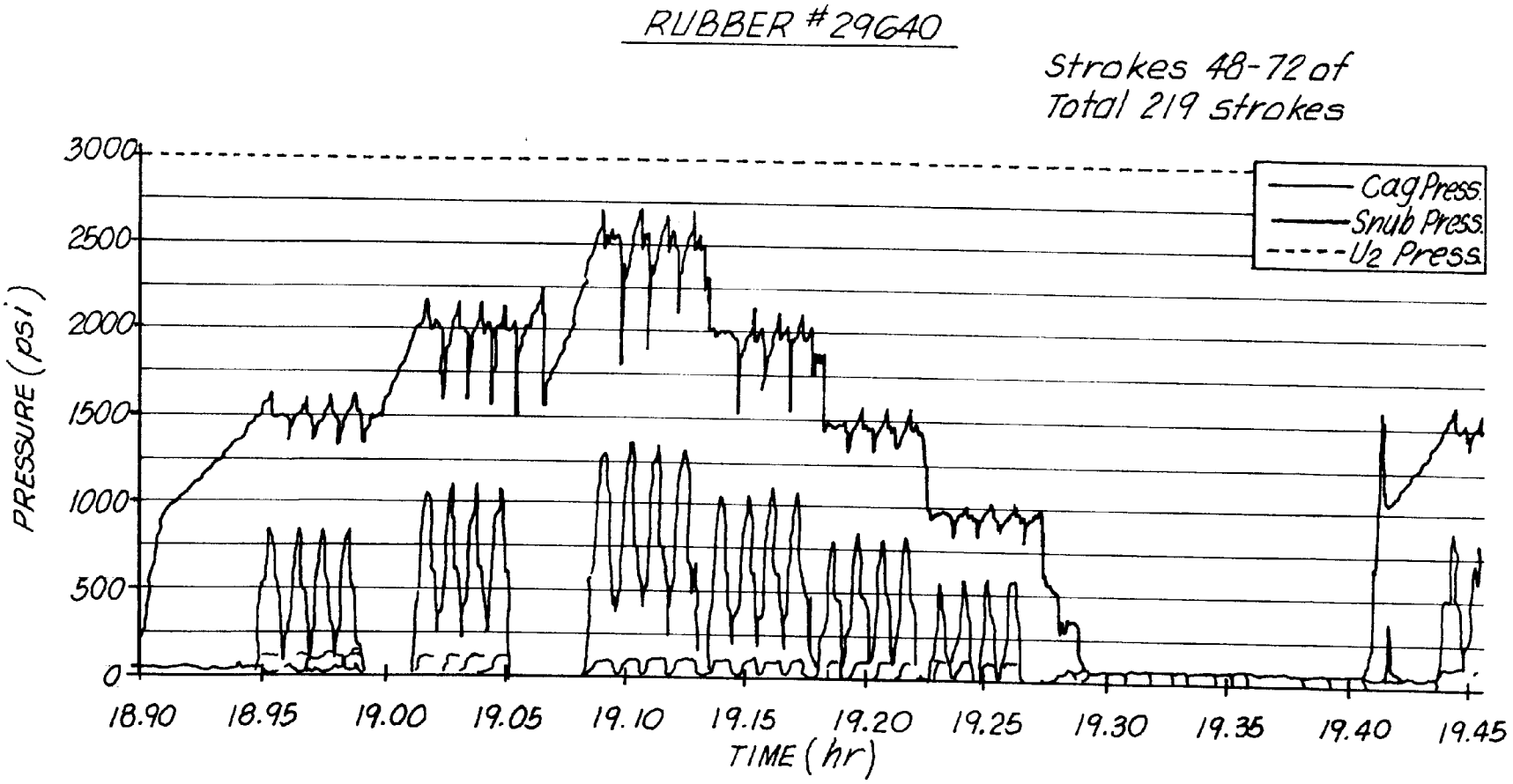
FIG. 5 is a chart of a performance test of stripper rubbers made in accordance with a first embodiment of this invention.

A typical cycle of data recorded during the tests using a high speed data acquisition system is shown in FIG. 5. In this cycle, the casing pressure was first increased to 1500 psi by introducing water into the test stand using a Triplex cementing pump. Pressure was controlled by means of a Swaco automatic choke that allowed water to bypass back into suction tanks after reaching a set-point pressure. Next, the drill pipe was stripped downward through the stripper rubber into the simulated well. The first positive casing pressure peak and snub hydraulic pressure peak shown on the plot corresponds to this downward motion of the drill pipe passing through the stripper rubber. Next the drill pipe was stripped up and out of the simulated well by reducing the pressure on top of the hydraulic pistons. This corresponds to the first local minimum on the casing pressure and snub pressure plot. It also corresponds to the peak in the hydraulic lift pressure below the hydraulic pistons of the snubbing unit.

After the drill pipe was stripped in and out of the simulated well four times, the pressure of the casing was changed by 500 psi. Note that for the test cycle shown, the drill pipe was stripped in and out of the well four times each at casing pressures of 1500 psi, 2000 psi, 2500 psi, 2000 psi, 1500 psi, and 1000 psi. This simulated typical underbalanced drilling conditions when a new fracture is cut by the bit. (A higher concentration of gas is circulated to the surface causing the casing pressure to slowly reach a peak value before decreasing back to the desired operating pressure.) After each cycle, a five-minute, static, low-pressure test of 50 psi or a high-pressure test of 5000 psi was conducted. Static pressure tests were conducted with an isolation valve closed to minimize system volume and allow even a small leak to be detected. The cycle was repeated nine times and then the sealing element was removed and examined for wear.

A test was also conducted with the casing pressure held at a constant value of 2500 psi during the entire test. This was done in order to verify that the life of the sealing element was acceptable when operating continuously at its working pressure. Static low pressure tests were conducted every 24 joints as in the other tests. After successful test results were achieved at the designed working pressure, tests were also conducted with the casing pressure held at a constant value of 3000 psi during the entire test. This was done in order to determine the escalation in the wear rate that could be expected at pressures above the working pressure.

The summary of the test results for the Model 7100 stripper rubbers is shown in Table 2.

TABLE 2

| Test Results | | | | |
|---|---|---|---|---|
| Casing Pressure (psi) | Tool Joints Stripped (up & down) | No. of Pressure Tests Conducted | Test Pressure (psi) | Failures Observed |
| 1000–2500 | 219 | 9 | 50 | None |
| 2500 | 350 | 15 | 50 | None |
| 3000 | 143 | 5 | 5000 | Seal Failed on Joint 143 |
| 3000 | 136 | 5 | 5000 | Seal Failed on Joint 136 |

The wear observed during these tests did not lead to a loss in the ability to seal either at low or high pressures. The wear rate of the stripper rubbers was found to escalate significantly above the working pressure of 2500 psi and was observed to be more severe when stripping a tool joint in the upward direction. Although drilling with pressures above 2500 psi with the Model 7100 is not recommended, the results indicated that significant stripper rubber life can be achieved even at 3000 psi.

These test results are believed to provide a positive indication of the success of the first embodiment of the invention for the stripper rubber 16, wherein a homogeneous mixture of chopped fibers was mixed throughout the stripper rubber composition. The enhancement of wear indicated by the results of Table 2 is believed to be significant and will provide to the industry a stripper rubber of higher performance than is known in the prior art.

Having described the invention above, various modifications of the techniques, procedures, material and equipment will be apparent to those in the art. It is intended that all such variations within the scope and spirit of the appended claims be embraced thereby.

What is claimed is:

1. A stripper rubber for sealing about an oilfield component, the stripper rubber having a bore for receiving the oilfield component, the stripper rubber comprising:

an upper throat section generally cylindrical in shape; and a lower nose section generally conical in shape, wherein the nose section has an interior that includes an inwardly tapered section, and a cylindrical section below the inwardly tapered section, the inwardly tapered section including a convex knee component adjacent to the throat section and a concave component below the convex knee component, the convex knee component projecting inwardly into the bore.

2. The stripper rubber of claim 1, wherein a rubber material is used and fibers are mixed into the rubber material, the fibers being less than about 4 mm in length.

3. The stripper rubber of claim 2, wherein the fibers are less than about 2 percent by weight.

4. The stripper rubber of claim 3, wherein the fibers are an aramid fiber.

5. A seal for a well bore component for use in oil and gas wells, water and geothermal wells, comprising:

a rubber material; and fibers mixed into the rubber material, wherein the fibers and rubber material are vulcanized to form a sealing element comprising a body having a bore, the body having a generally cylindrical interior surface and a generally funnel-shaped conical interior surface below the cylindrical interior surface and a bumper projecting inwardly into the bore between the cylindrical interior surface and the conical interior surface, wherein the sealing element can stretch to receive the oilfield component in a longitudinal insertion through the bore, and wherein the fibers enhance wear resistance of the sealing element for extending the service life of the sealing element.

6. The seal of claim 5, wherein the fibers are a pulp having a length between about 1 and 3 mm.

7. The seal of claim 5, wherein the fibers are a dipped, chopped fiber.

8. The seal of claim 5, wherein the fibers are aramid fibers.

9. A stripper rubber for a well bore component, comprising:

a rubber material; and fibers mixed into the rubber material, wherein the fibers and rubber material are vulcanized to form a sealing element having a nose area and a throat area with a common bore therethrough, wherein the sealing element in the nose area can stretch to receive the well bore component in a longitudinal insertion through the bore, wherein the fibers enhance wear resistance of the sealing element for extending the service life of the sealing element; and wherein the fibers are oriented generally longitudinally in the throat area.

10. The stripper rubber of claim 9, wherein the fibers are oriented generally radially in the nose area.

11. The stripper rubber of claim 9, wherein the bore is defined by a generally cylindrical upper section in the throat area and a generally cylindrical lower section and a conical section in the nose area, and wherein the sealing element has a knee component projecting inwardly into the bore between the generally cylindrical upper section and the conical section.

12. The stripper rubber of claim 9, wherein the fibers in the nose area are less than 10 mm in length.

13. The stripper rubber of claim 12, wherein the fibers in the throat area are greater than about 2 mm in length.

14. The stripper rubber of claim 13, wherein the fibers are included at between 1 and 4 weight percent.

15. The stripper rubber of claim 9, wherein the fibers are an aramid fiber.

16. The stripper rubber of claim 9, wherein said nose area has an interior that includes a convex knee component adjacent to the throat area and a concave component between the convex knee component and the nose area, said convex knee component having a substantially larger radius of curvature than the concave component.

17. The stripper rubber for a well bore component, comprising:

a rubber material; and fibers mixed into the rubber material, wherein the fibers and rubber material are vulcanized to form a sealing element having a nose area and a throat area with a common bore therethrough, wherein the sealing element in the nose area can stretch to receive the well bore component in a longitudinal insertion through the bore, wherein the fibers enhance wear resistance of the sealing element for extending the service life of the sealing element, and wherein the fibers are included in both the throat area and the nose area, and the fibers are oriented generally radially in the nose area and generally longitudinally in the throat area.

18. A method for making a seal for a well bore component, comprising:

adding fibers to a rubber material;

kneading the rubber material;

vulcanizing the rubber material in a mold to form a sealing element having a bore, wherein the sealing element can stretch to receive the oilfield component in a longitudinal insertion through the bore, wherein the fibers enhance a property of the sealing element for extending the service life of the sealing element, wherein the sealing element has an interior surface, and wherein the sealing element has a throat section and a nose section, wherein the fibers are oriented radially in the nose section and longitudinally in the throat section.

19. The method of claim 18, wherein the fibers in the throat section are generally longer than the fibers in the nose section.

20. A method for making a seal for a well bore component, comprising:

adding fibers to a rubber material;

kneading the rubber material;

vulcanizing the rubber material in a mold to form a sealing element having a bore;

wherein the sealing element can stretch to receive the oilfield component in a longitudinal insertion through the bore;

wherein the fibers enhance a property of the sealing element for extending the service life of the sealing element;

wherein the sealing element has a throat section and a nose section orienting the fibers and placing the rubber material in the mold prior to the vulcanizing step so that the fibers are oriented radially in the nose section; and wherein the fibers are generally oriented longitudinally in the throat section.

21. The method of claim 20, wherein the nose section has a convex knee component adjacent the throat section and a concave component below the convex knee component.

22. A stripper rubber for sealing around an oilfield component, comprising:

a body having a bore, an upper end and a lower end, the body having an interior profile defining the bore, the interior profile comprising:

an upper cylindrical section adjacent to the upper end;

a bumper below the upper cylindrical section, the bumper having an upper portion and a lower portion, the upper portion having a surface projecting inwardly into the bore, the lower portion having a surface extending downwardly;

a conical section below the bumper, the conical section funneling downwardly and inwardly; and a lower cylindrical section below the conical section and proximate to the lower end.

23. The stripper rubber of claim 22, further comprising a concave section between the bumper and the conical section.

24. The stripper rubber of claim 22, wherein the upper cylindrical section has an interior surface and the surface on the upper portion of the bumper is transverse to the interior surface of the upper cylindrical section.

25. The stripper rubber of claim 22, further comprising a concave section between the bumper and the conical section, the concave section having a concave radius of curvature, and wherein the bumper has a convex radius of curvature.

26. The stripper rubber of claim 25, wherein the radius of curvature of the bumper is greater than the radius of curvature of the concave section.

* * * * *